US005308737A

United States Patent [19]

Bills et al.

[11] Patent Number: 5,308,737

[45] Date of Patent: May 3, 1994

[54] LASER PROPULSION TRANSFER USING BLACK METAL COATED SUBSTRATES

[75] Inventors: Richard E. Bills; Hsin-hsin Chou, both if Woodbury; William V. Dower, St. Paul; Martin B. Wolk, Woodbury, all of Minn.

[73] Assignee: Minnesota Mining and Manufacturing Company, St. Paul, Minn.

[21] Appl. No.: 33,112

[22] Filed: Mar. 18, 1993

[51] Int. Cl.[5] ..... G03C 5/54; G03C 1/94

[52] U.S. Cl. ..... 430/201; 430/275; 430/276; 430/278; 430/945; 430/964

[58] Field of Search ..... 430/201, 964, 275, 276, 430/278, 945, 277, 279

[56] References Cited

U.S. PATENT DOCUMENTS

| | | | |
|---|---|---|---|
| 4,587,198 | 5/1986 | Fisch | 430/201 |
| 4,599,298 | 7/1986 | Fisch | 430/271 |
| 4,657,840 | 4/1987 | Fisch | 430/201 |
| 4,705,739 | 11/1987 | Fisch | 430/276 |
| 5,089,372 | 2/1992 | Kirihata et al. | 430/167 |
| 5,156,938 | 10/1992 | Foley et al. | 430/200 |
| 5,171,650 | 12/1992 | Ellis et al. | 430/20 |

FOREIGN PATENT DOCUMENTS

| | | |
|---|---|---|
| 63-60793 | 3/1988 | Japan . |
| 63-161445 | 7/1988 | Japan . |
| 63-165179 | 7/1988 | Japan . |
| 64-14081 | 1/1989 | Japan . |

OTHER PUBLICATIONS

USSN 07/977,215, filed Nov. 16, 1992, Propellant-Containing Technical Transfer Donor Elements.

*Primary Examiner*—Richard L. Schilling

*Attorney, Agent, or Firm*—Gary L. Griswold; Walter N. Kirn; Mark A. Litman

[57] ABSTRACT

This invention relates to a laser imageable donor material that is capable of transferring pigment to a receiver, such as plain paper, polymeric film, metal and the like. The donor material is composed of at least a transparent film, an overlying layer of vapor coated black aluminum, and a dye coating or pigment coating dispersed on top of the black aluminum. A material which generates gas when irradiated may also be present as a separate layer under or in the dye or pigment layer and above the black aluminum layer. The construction can be addressed with diode lasers and diode-pumped solid state lasers.

The invention can be used to produce large format digital halftone color proofs using high power air-cooled diode-pumped Nd:YAG and Nd:YLF lasers. Other materials could be transferred from the donor sheet in this process as 7ell as the colorant (dye or pigment) layer.

17 Claims, No Drawings

LASER PROPULSION TRANSFER USING BLACK METAL COATED SUBSTRATES

BACKGROUND OF THE ART

Laser propulsive transfer imaging has been studied for over 20 years. Work in this field 7as largely based on the use of high power flashlamp 7ater-cooled Nd:YAG lasers capable of producing more than 5 W of power. Recently, diode-pumped solid state lasers have become available in the 0.2 to 4 W range. This laser technology 7/uld make laser propulsive transfer imaging more commercially feasible since diode-pumped lasers are compact, air-cooled, and relatively maintenance-free.

The process in 7hich the article of the invention is used provides a donor element which has a laser propulsive transfer material, an absorber component and the material to be transferred, the latter two of which may be incorporated into a single or multilayer coating that is applied to a transparent substrate such as polyester. This donor sheet is then placed in contact with a receiver substrate (plain paper, aluminum, coated polyester, etc.) and imaged (irradiated from the back or front) 7ith the laser. Material is transferred from the donor to the receptor only in those locations where laser heating has occurred. It is believed that the rapid absorption of laser energy produces a rapid expansion or devolution of gases in the donor sheet from thermal expansion and/or decomposition, and this expansion induces a rapid evolution of gas which has been compared to a shock wave that propels the transfer material from the donor to the receptor. Since the material is heated adiabatically, the exposure energy required is reduced to less than 0.2 J/cm$^2$. The transfer process is fast, requiring pixel dwell times of only a few 100 ns. This means that A3 size format images can be produced in less than 2 minutes using a 4 W laser.

In the past, carbon black/nitrocellulose coatings were used to transfer crosslinkable resins to aluminum printing plates and to make films and black and white proofs. More recently, a decomposable polymer was disclosed in U.S. Pat. Nos. 5,156,938 and 5,171,650 7hich could be used to transfer pigment for color proofing applications. These patents describe the use of Cyasorb 165 IR dye to absorb the laser power. This IR dye has a low absorptivity in the visible region, thus preventing excessive visible staining of the pigment. This IR (Infra-Red) dye was also used as an absorber in glycidyl azide polymer (GAP) imaging materials described in U.S. patent application Ser. No. 07/977,215 filed on Nov. 17, 1992 titled "PROPELLANT-CONTAINING THERMAL TRANSFER DONOR ELEMENTS." However, some visible residue may still be present after imaging. In addition, dye lifetime stability may also be poor.

BRIEF DESCRIPTION OF THE INVENTION

The present invention relates to a thermal transfer donor sheet and to a thermal transfer donor process. The sheet comprises a backing layer (7hich should be transparent if backside irradiation is used), a layer comprising black metal (preferably aluminum or tin oxide) as a radiation absorbing material, a gas forming composition 7hich decomposes into gas when irradiated, and a colorant material over the gas forming composition or in the same layer as the gas forming material. The black metal (e.g., aluminum) has been found to be a very stable and highly efficient radiation absorber for converting the radiation to heat energy to effect heat transfer.

It has also been found to be desirable to include either alone or in combination infrared-absorbing (heat-absorbing) dyes into the colorant layer (particularly where a thermal mass transfer process is considered) or the gas-forming composition to improve the quality of the transfer process. The absorber dye is not intended only to be present to directly absorb the imaging radiation, but also to absorb heat to maintain the temperature of the composition in which it is present at a higher level, or to have that composition reach that higher temperature more rapidly.

In order to circumvent the weaknesses of IR dye absorbers, black aluminum has been used in the present invention as a primary radiation absorber in thermal transfer donor media. Mixed oxides of aluminum were vapor coated onto polyester, and pigment was coated (vapor coated or in a binder) on top of this layer. Upon laser-induced heating, the black aluminum exothermically oxidized to $Al_2O_3$, which is colorless, and propelled the pigment to the receiver. The advantage of this material system is that the absorber is bleached, and the donor film can be used as an imagesetting film since it absorbs in the UV. U.S. Pat. Nos. 5,156,938 and 5,171,650 disclose the use of aluminum film, and disclose aluminum oxides generically. However, they do not have an example demonstrating aluminum oxides, nor do they mention mixed oxides, and nor do they show or describe black aluminum such as that used in this invention. Other examples of shiny metallic vapor coated aluminum used in an ablative 7riting film appear in U.S. Pat. No. 5,089,372, and in U.S. Pat. No. 4,587,198.

Black aluminum has been used in the past as a heat absorbing or light absorbing film for many applications, including resist and thermal transfer imaging (see especially Examples 6 and 7 where dye coatings on the black aluminum are transfered by ablation). Black aluminum has not been used with gas generating-decomposing compositions as are described herein. The use of the black aluminum 7ith gas generating compositions in or under the colorant layer has been found to improve the efficiencies of both the black aluminum and the gas generating compositions. It is not known 7hy, but the layers are much more stable than prospectively envisioned and the energy use in the thermal transfer is at a much higher efficiency than is expected from an analysis of the individual components.

In U.S. Pat. No. 4,426,437, the preparation of highly absorbing metal films is discussed, as is their use in photoresist materials. U.S. Pat. No. 4,552,826 teaches an improvement in this type of one-color imaging material. A color imaging application for these black metal coatings is taught in U.S. Pat. No. 4,587,198. Example 13 shows a construction consisting of a heat-diffusable dye and black aluminum, sequentially deposited on a flexible substrate. This is then exposed to image-wise radiation which ablates the metal, and allows subsequent image-wise dye diffusion to a receptor sheet. This concept is further elaborated in U.S. Pat. Nos. 4,599,298, 4,657,840, and 4,705,739. These are distinct from the current invention, in that the imaging processes of these references require two steps: the laser irradiation coming in a different phase from colorant transfer.

U.S. Pat. /. 4,430,366 describes a process and apparatus for the manufacture of black aluminum. The black aluminum may have many different structural aspects to it. The back surface may be shiny (usually indicating that aluminum is the back surface), gray (indicating a mixture of aluminum and alumina or an incomplete oxydation of the aluminum), or black (indicating that the black aluminum begins on the substrate surface). These variations can be seen readily when a transparent backing layer is used.

The backing layer or support layer used for the thermal donor transfer sheet of the present invention may comprise any sheet material, although transparent polymeric film which would allow for backside irradiation is preferred. This would particularly include polyester substrates (e.g., polyethyleneterephthalate), polycarbonates, polyolefins, cellulosic materials (cellulose acetate, cellulose triacetate, cellulose nitrate), polyvinyl resins, polyamides, and the like. If a non-transparent substrate is used, the process must be modified to accommodate the opacity of the base. Ordinarily, a transparent receptor must be used so that the irradiation takes place through the receptor layer. The base need not be completely transparent for backside imagewise irradiation according to the practice of the present invention, however. F/r example, even the black aluminum layer may be partially opaque or radiation absorbing in regions before the appearance of black aluminum. That is, in the case of black aluminum 7ith a silvery reverse surface, there may be some aluminum present which will filter some amount of light and still allow excellent performance of the practice of the invention.

Preferred gas emitting compositions for use in the practice of the present invention are those disclosed in U.S. patent application Ser. No. 07/977,215 described above.

SUMMARY OF THE INVENTION

In accordance with the present invention, it has now been discovered that a gas-producing polymer with a thermally available nitrogen content of greater than about 10 weight percent (as defined later herein) serve as excellent propellants for thermal mass transfer materials.

Thus, in one embodiment, the present invention provides thermal transfer donor elements comprising a substrate having coated on at least a portion thereof a layer comprising: (a) a gas-producing polymer having a thermally available nitrogen content of greater than about 10 weight percent; (b) a black metal radiation absorber; and (c) a thermal mass transfer material.

In another embodiment, the present invention provides thermal transfer donor elements comprising a substrate having coated on at least a portion thereof a first layer comprising: (a) a gas-producing polymer having a thermally available nitrogen content of greater than about 10 weight percent, and (b) a black metal radiation absorber; and a second layer comprising a thermal mass transfer material coated onto the first layer.

In another embodiment, the present invention provides thermal transfer donor elements comprising a substrate having coated successively thereon: (a) a first layer comprising a black metal radiation absorber; (b) a second layer comprising a gas-producing polymer, preferably having a thermally available nitrogen content of greater than about 10 7eight percent; and (c) a third layer comprising a thermal mass transfer material.

In still another embodiment, the present invention provides thermal transfer donor elements comprising a substrate having successively coated thereon: (a) a first layer comprising a gas-producing polymer having a thermally available nitrogen content of greater than about 10 weight percent; (b) a second layer comprising a black metal radiation absorber; and (c) a third layer comprising a thermal mass transfer material.

DETAILED DESCRIPTION OF THE INVENTION

The colorant materials used in the constructions and processes of the present invention comprise dyes, dye compositions, pigments and pigment compositions. The dyes may be vapor coated or coated out of solvents to form a layer, and the pigments may be vapor coated or coated out in a binder to form a layer. The layer containing the colorant may be distinct from the gas-generating polymer layer or may be part of that layer (e.g., the colorant blended or dissolved into the gas-generating layer). The colorant materials may represent any color, including non-visible, but mechanically detectible colors such as the infrared and ultraviolet regions of the spectrum. Of more importance is the use of visible radiation absorbing colorants such as cyan, magenta, yellow, red, blue, green, black, and non-traditional printing colors such as flourescent colors, metallic pigments, and tailored colors 7hich are not primary additive or substractive colors.

Preferably, the gas-producing polymer has a thermally available nitrogen content of greater than about 20 weight percent and more preferably, greater than about 30 weight percent.

In one preferred embodiment, the gas-producing polymer has the following formula:

$$(X\leftarrow R\rightarrow_n)_m L \qquad (I)$$

7herein:

X represents a hydroxyl, mercapto, or amino group;

R represents a divalent monomer group, containing a thermally decomposable nitrogen-containing group, derived from an oxirane, a thiirane, or aziridine group;

L represents a mono-, di-, tri- or tetra-valent alkyl radical and correspondingly, m represents 1, 2, 3, or 4; and n represents any integer greater than 1.

It is preferred that the foregoing gas producing polymer of F/rmula I is reacted with a suitable crosslinking agent.

In another preferred embodiment, the gas-producing polymer is a polyoxetane having recurring units of the following formula:

$$-CH_2-\underset{R^2}{\overset{R^1}{C}}-CH_2-O- \qquad (II)$$

7herein $R^1$ and $R^2$ each independently represent a thermally decomposable nitrogen-containing group; e.g., azido, nitrate, nitro, triazole, etc.

In another preferred embodiment, the gas-producing polymer is an energetic copolymer having repeating units derived from different monomers, one or both of which have pendant energetic nitrogen-containing groups such as azido, nitro, nitrate, etc. Preferably the monomers are cyclic oxides having three to six atoms in the ring. The energetic polymers are preferably azido, nitro, or nitrato derivatives of oxetane or tetrahydrofuran. Copolymerization is preferably carried out by cationic polymerization according to the disclosure of U.S. Pat. /. 4,483,978 incorporated by reference herein.

As used herein:

"thermally available nitrogen content" refers to the nitrogen content (7eight percentage basis) of a material which upon exposure to heat (preferably less than about 300° C. and more preferably less than about 250° C.) generates or liberates nitrogen ($N_2$) gas;

"thermally decomposable nitrogen-containing group" refers to a nitrogen-containing group (e.g., azido, nitrate, nitro, triazole, etc.) which upon exposure to heat (preferably less than about 300° C., more preferably less than about 250° C.) generates or liberates $_2$ gas.

"thermal mass transfer material" refers to a material such as, for example, a colorant, pigment, or a crystalline dye (7ith or without binder) which is transferred in thermal imaging processes from a donor element to the surface of a receptor element by action of a thermal source, but without sublimation of the material;

"group" refers to not only pure hydrocarbon chains or structures such as methyl, ethyl, cyclohexyl, and the like, but also to chains or structures bearing conventional substituents in the art such as hydroxy, alkoxy, phenyl, halo (F, Cl, Br, I), cyano, nitro, amino, etc.; and "radical" refers to the inclusion of only pure hydrocarbon chains such as methyl, ethyl, propyl, cyclohexyl, isooctyl, tert-butyl, and the like.

The inventive thermal transfer donor elements utilize propellant materials which produce a high propulsive force, thereby decreasing the exposure fluence required to induce transfer of imaging material to a receptor layer material. F/r example, exposure fluences of 0.2 $J/cm^2$ and pixel dwell times of 300 nanoseconds have been achieved utilizing the propellant materials disclosed herein, thus enabling the use of simple, single-beam scanners based /n diode-pumped lasers such as diode-pumped d:YAG lasers. The propellant materials utilized herein can be stored easily and exhibit good shelf life stability as compared to nitrocellulose and other propellants. Additionally, no corrosive gases are produced by the propellant. The thermal transfer donor elements of the present invention can be used to transfer colorants directly to a 7ide variety of substrates including plain paper.

Thermal transfer donor elements of the present invention comprise a substrate having on one surface thereof a black metal layer (generally comprising an optically dense metal oxide or metal oxide/metal mixture); a propellant layer comprising a gas-producing polymer having a thermally available gaseous evolution product and decomposition product, preferably a nitrogen content greater than about 10 weight percent, preferably greater than about 20 weight percent, and more preferably greater than about 30 7eight percent; an optional radiation absorber; and a thermal transfer material comprising a colorant (e.g., a dye or dye/pigment in a binder). Preferably, the gas evolving or nitrogen content of the reaction product is thermally decomposable at a temperature below about 300° C., and most preferably, below about 250° C. The radiation absorber and transfer material may be included in either the propellant layer or in a separate layer coated adjacent to, e.g., onto the propellant layer.

The black metal layer is preferably black aluminum or black tin and may be produced according to the teachings of U.S. Pat. No. 4,430,366. By the term "black" it is meant that the metal layer provides a transmission optical density of at least 0.3, preferably at least 0.6, more preferably at least 0.8, and most preferably at least 1.0 at the wavelength of the imaging radiation (as a standard, 830 nm is used), and the reflected light is less than 20% of the incident light on the black surface.

Substantially any metal capable of forming an oxide or sulfide can be used in the practice of this invention for the black metal layer. In particular aluminum, tin, chromium, nickel, titanium, cobalt, zinc, iron, lead, manganese, copper and mixtures thereof can be used. Not all of these metals when converted to metal oxides according to this process will form materials having all of the specifically desirable properties (e.g., optical density, light transmissivity, etc.). However, all of these metal oxide containing layers formed according to the practice of the present invention will be useful and contain many of the benefits of the present process including bondability to polymeric materials. The metal vapors in the chamber may be supplied by any of the various known techniques suitable for the particular metals, e.g., electron beam vaporization, resistance heaters, etc. Reference is made to *Vacuum Deposition of Thin Films*, L. Holland, 1970, Chapman and Hall, London England with regard to the many available means of providing metal vapors and vapor coating techniques, in general.

Metal oxide or metal sulfide containing layers, the black metal layers according to the present invention may be deposited as thin as layers of molecular dimensions up through dimensions in micrometers. The composition of the layer throughout its thickness may be readily controlled as herein described. Preferably the metal/metal oxide or sulfide layer will be between 50 and 5000 Å in its imaging utilities, but may contribute bonding properties when 15 Å, 25 Å or smaller and structural properties when $5\times10^4$ Å or higher.

The conversion to graded metal oxide or metal sulfide is effected by the introduction of oxygen, sulfur, water vapor or hydrogen sulfide at points along the metal vapor stream. By thus introducing these gases or vapors at specific points along the vapor stream in the vapor deposition chamber, a coating of a continuous or graded composition (throughout either thickness of the layer) may be obtained. By selectively maintaining a gradation of the concentration of these reactive gases or vapors across the length of the vapor deposition chamber through which the substrate to be coated is being moved, an incremental gradation of the composition of the coating layer (throughout its thickness) is obtained because of the different compositions (i.e., different ratios of oxides or sulfides to metals) being deposited in different regions of the vapor deposition chamber. One can in fact deposit a layer comprising 100% metal at one surface (the top or bottom of the coating layer) and 100% metal oxide or sulfide at the other surface. This kind of construction is a particularly desirable /ne because it provides a strong coherent coating layer with excellent adhesion to the substrate.

A substrate 7hich is to be coated continuously moves along the length of the chamber from an inlet area of the vapor deposition chamber to an outlet area. Metal vapor is deposited over a substantial length of the chamber, and the proportion of metal oxide or sulfide being codeposited 7ith the metal at any point along the length of the chamber (or deposited as 100% oxide or sulfide) depends upon the amount of reactive gas or vapor which has entered that portion of the metal vapor stream 7hich is being deposited at that point along the length of the chamber. Assuming, for purposes of illustration, that an equal number of metal atoms (as metal or oxides or sulfides are being deposited at any time at any point along the length of the chamber, gradation in the deposited coating is expected by varying the amount of oxygen or sulfur containing reactive gas or vapor which contacts the metal vapor at various points or areas along the length of the chamber. By having a gradation of increasing amounts of reactive gas along the length of the chamber, one gets a corresponding gradation in the increased proportions of oxide or sulfide deposited. Deposition of metal vapor is seldom as uniform as that assumed, but in actual practice it is no more difficult according to the procedures of the present invention to locally vary the amount of oxygen, 7ater, sulfur or hydrogen sulfide introduced into different regions of said metal vapor along the length of the surface of the substrate to be coated as the substrate is moved so as to coat the surface 7ith a layer having varying ratios of metal/(metal oxide or sulfide) through its thickness. It is desirable that the reactive gas or vapor enter the stream itself and not just diffuse into the stream. The latter tends to cause a less controllable distribution of oxides within the stream. By injecting or focussing the entrance of the reactive gas or vapor into the stream itself, a more consistent mixing in that part of the stream is effected.

Transitional characteristics bear an important relationship to some of the properties of the black metal products. The coating has dispersed phases of materials therein, one the metal and the other the metal oxide or sulfide. The latter materials are often transparent or translucent, while the former are opaque. By controlling the amount of particulate metal which remains dispersed in the transparent oxide or sulfide phase, the optical properties of the coating can be dramatically varied. Translucent coatings of yellowish, tan, and gray tones may be provided, and substantially opaque black film may be provided from a single metal by varying the percentage of conversion of the metal to oxide during deposition of the coating layer.

The gas-producing polymer may be any polymer that liberates gas, especially nitrogen gas ($N_2$) when heated rapidly, such as, for example, by exposure to an infrared laser beam. Polymers that liberate nitrogen gas on heating generally have thermally decomposable functional groups. The polymer may itself be gas-liberating or may contain a dispersion or addition of materials that can decompose to produce gases when irradiated, such as diazonium salts and polymers. Non-limiting examples of suitable thermally decomposable functional groups include azido, alkylazo, diazo, diazonium, diazirino, nitro, difluoroamino, $CF(NO_2)_2$, cyano, nitrato, triazole, etc. The thermally decomposable groups may be incorporated into the gas-producing polymer either prior to polymerization or by modification of an existing polymer, such as, for example, by diazotization of an aromatic ring (e.g., with sodium nitrite) or diazo transfer with tosyl azide onto an amine or $\beta$-diketone in the presence of triethylamine.

An energetic polymer may be defined as a polymer which contains functional groups 7hich exothermically decompose to generate gases, shock 7aves, pressure, etc. when heated above a certain threshold temperature on the millisecond to nanosecond timescale. Such polymers may contain, for example, azido, nitrato, and nitramino functional groups. Examples (non-inclusive) of such polymers are poly[bis(azidomethyl)]oxetane (BAMO), glycidyl azide polymer (GAP), polyvinyl nitrate (PVN), nitrocellulose, and polycarbonates. An energetic polymer may also be defined as a polymeric material which contains energetic additives, gas forming additives, or catalysts for the thermal or photochemical decomposition thereof.

Energetic additives may be used to modify the physical and thermal properties of the abovementioned energetic polymers. Such additives may be used as plasticizers or "kickers", which lower the decomposition temperature. Examples (non-inclusive) of such additives are the energetic molecules RDX (hexahydro-1,3,5-trinitro-1,3,5-triazine), TNT (trinitrotoluene), and PETN (pentaerythritol tetranitrate).

Gas forming additives are molecules which thermally decompose to form a large quantity of gaseous products. Examples (non-inclusive) include diazonium salts (e.g., 4-methoxybenzene diazonium tetrafluoroborate), azides (e.g., 4-azidobenzoic acid), and "blowing agents" (e.g., 2,2'-azobis-2-methylbutyronitrile and p-toluene sulfonylhydrazide).

Catalysts are compounds which lower the temperature of decomposition of the energetic polymers or additives. Examples (non-inclusive) include acids, bases, and organometallic species such as ferric acetylacetonate.

In one preferred embodiment, the gas-producing polymer has the following formula:

$$(X\leftarrow R\rightarrow_n)_m L \qquad (I)$$

wherein:

X represents a hydroxyl, mercapto, or amino (including mono-alkyl and aryl substituted amino) group. Preferably X is a hydroxyl group.

R represents a divalent monomer group, containing a thermally decomposable nitrogen-containing group, derived from an oxirane such as, for example, $-CH_2CH(CH_2N_3)O-$, $-CH(CH_2N_3)CH_2O-$, $-CH_2C(CH_2N_3)_2CH_2O-$, $-CH(CH_2N_3)CH(CH_2N_3)O-$, and $-CH_2CH(N_3)CH_2O-$; a thiirane such as, for example, $-CH_2CH(CH_2N_3)S-$, $-CH(CH_2N_3)CH_2S-$, $-CH_2C(CH_2N_3)_2CH_2S-$, $-CH(CH_2N_3)CH(CH_2N_3)S-$, and $-CH_2CH(N_3)CH_2S-$; and an aziridine such as, for example, $-CH_2CH(CH_2)N(CH_3)-$, $-CH_2CH(CH_2N_3)CH_3-$, $-CH(CH_2N_3)CH_2NH-$, $-CH_2C(CH_2N_3)_2CH_2NH-$, $-CH(CH_2N_3)CH(CH_2N_3)N(CH_3)-$, and $-CH_2CH(N_3)CH_2N(CH_3)-$.

L represents a mono-, di-, tri- or tetra-valent alkyl radical. Non-limiting examples of monovalent radicals are methyl and ethyl. Non-limiting examples of polyvalent alkyl radicals are ethylene, methylene, propylene, 1,2,3-propanetriyl, 2,2-dimethylene-1,3-propanediyl, etc. Preferably, L is 1,2,3-propanetriyl.

C/rresponding to L, m represents 1, 2, 3, or 4.

n represents any positive integer greater than 1, preferably greater than 5, more preferably greater than 10.

The foregoing gas-producing polymer of F/rmula (I) can be made by procedures well known to those skilled in the art of synthetic organic chemistry such as disclosed, for example, in U.S. Pat. Nos. 3,645,917 and 4,879,419, the disclosures of which are incorporated herein by reference.

One or more crosslinking agents may be employed in combination with the gas-producing polymer of F/rmula I to provide coatings having improved strength. The choice of an appropriate crosslinking agent depends on the functional groups pendant on the gas-producing polymer. Thus, if hydroxyl groups are present on the gas-producing polymer, then crosslinking agents for polyols could be employed (e.g., isocyanates). In cases where free-radically polymerizable pendant groups, such as acrylates, are attached to the polymer backbone, a free-radical initiator may be used as a crosslinking agent.

Preferably, a crosslinking agent for polyols is employed in combination with a gas-producing polymer having multiple hydroxyl end groups. Preferred crosslinking agents in this case are polyisocyanates, including but not limited to, hexamethylene diisocyanate; diphenylmethane diisocyanate; bis(4-isocyanatocyclohexyl)methane, 2,4-tolylene diisocyanate, etc.

In another preferred embodiment, the gas-producing polymer is a polyoxetane having recurring units of the following formula:

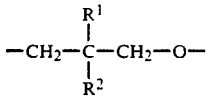

(II)

wherein $R^1$ and $R^2$ each independently represent a thermally decomposable nitrogen-containing group, e.g., azido, nitro, nitrato, triazole, etc. An example of a preferred azido group is $-CH_2N_3$.

The formula gas-producing polymer of F/rmula (II) can be made by procedures well known to those skilled in the art of synthetic organic chemistry such as disclosed, for example, in U.S. Pat. No. 3,694,383, the disclosure of which is incorporated herein by reference.

In another preferred embodiment, energetic copolymers having repeating units derived from different monomers, one or both of which have pendant energetic nitrogen-containing groups such as azido, nitro, or nitrato derivatives. Preferably the monomers are cyclic oxides having three to six ring atoms. The energetic monomers are preferably azido, nitro, triazole, or nitrato derivatives of oxirane, oxetane or tetrahydrofuran. C/polymerization of the monomers is preferably carried out by cationic polymerization. The foregoing energetic copolymers and their method of preparation are disclosed in U.S. Pat. No. 4,483,978, the disclosure of which is incorporated herein by reference.

Thermal mass transfer materials suitable for use in the present invention include dyes such as those listed in Venkataraman, *The Chemistry of Synthetic Dyes*; Academic Press, 1970: Vols. 1–4 and *The C/lour Index Society of Dyers and C/lourists*, Yorkshire, England, Vols. 1–8 including cyanine dyes (including streptocyanine, merocyanine, and carbocyanine dyes), squarylium dyes, oxonol dyes, anthraquinone dyes, and holopolar dyes, polycyclic aromatic hydrocarbons, etc.; metal oxides and mixed oxides such as titanium dioxide, silica, alumina, oxides of chromium, iron, cobalt, manganese, nickel, copper, zinc, indium, tin, antimony and lead, black aluminum; metal films derived from virtually any atmospherically stable metal including, but not limited to, aluminum, scandium, titanium, vanadium, chromium, manganese, iron, cobalt, nickel, copper, zinc, gallium, germanium, yttrium, zirconium, niobium, molybdenum, ruthenium, rhodium, palladium, silver, cadmium, indium, tin, antimony, lanthanum, gadolinium, hafnium, tantalum, tungsten, rhenium, osmium, iridium, platinum, gold, thallium, and lead; colored and/or fluorescent pigments known for use in the imaging arts including those listed in the *Pigment Handbook*; Lewis, P. A., Ed.: Wiley; New York, 1988, or available from commercial sources such as Hilton-Davis, Sun Chemical C/., Aldrich Chemical C/., Imperial Chemical Industries, etc.; semiconductors such as carbon (including diamond graphite), silicon, arsenic, gallium arsenide, gallium antimonide, gallium phosphide, aluminum antimonide, indium antimonide, indium tin oxide, zinc antimonide, etc.; electrographic or electrophotographic toners; phosphors, such as those used for television or medical imaging purposes; electroless plating catalysts; polymerization catalysts; curing agents; and photoinitiators.

Also, it is often desirable to thermal mass transfer materials to a substrate to provide a modified surface (for example, to increase or decrease adhesion or wetability) in an image-wise fashion. For those applications, the transfer materials may be polymers or copolymers such as silicone polymers as described by M. W. Ranney in *Silicones*: Noyes Data C/rp., 1977, Vols. 1 and 2; fluorinated polymers, polyurethanes, acrylic polymers, epoxy polymers, polyolefins, styrene-butadiene copolymers, styrene-acrylonitrile copolymers, polyethers, and phenolic resins such as novolak resins, and resole resins.

In other cases it is desirable to transfer curable materials such as monomers or uncured oligomers or crosslinkable resins. In those cases the thermal mass transfer material may be a polymerizable monomer or oligomer. The properties of the material should be selected so that volatility of the monomer or oligomer is minimal to avoid storage problems. Suitable polymerizable materials include acrylate-terminated polysiloxanes, polyurethanes, polyethers, etc.

When the thermal mass transfer material is coated as a separate layer on the propellant it may be coated by a variety of techniques known in the art including, but not limited to, coating from a solution or dispersion in an organic or aqueous solvent (e.g., bar coating, knife coating, slot coating, slide coating, etc.), vapor coating, sputtering, gravure coating, etc., as dictated by the requirements of the thermal mass transfer material itself.

To improve speed of the thermal mass transfer materials utilized in the present invention, one or more accelerators for azide decomposition may be added to the propellant layer or a layer adjacent thereto. Useful accelerators for azide decomposition include those materials known in the art to reduce the decomposition temperature of alkyl azide compounds including, but not limited to, metal complexes such as ferrous acetylacetonate, stannous chloride, magnesium chloride, ferric chloride, zinc bromide, etc.; protic acids such as benzoic acid, acetic acid, p-toluenesulfonic acid, etc.; thermally sensitive free-radical initiators such as benzoyl peroxide, t-butyl perbenzoate, etc.; phosphines such as triphenylphosphine; and the like.

Sensitivity of the thermal mass transfer donor elements of the present invention may also be increased by incorporation of a surfactant (as described by M. R. Porter in *Handbook of Surfactants*: Blackie, Chapman and Hall; New York, 1991), preferably a fluorochemical surfactant. The surfactant may be incorporated in any of the layers of the thermal transfer donor element, preferably in the top layer of the donor element containing the thermal mass transfer material in order to reduce cohesion. Non-limiting examples of fluorochemical surfactants include Fluorad TM surfactants sold by 3M C/mpany.

Suitable donor substrates include plastic sheets and films such as those made of polyethylene terephthalate, fluorene polyester polymer consisting essentially of repeating interpolymerized units derived from 9,9-bis(4-hydroxyphenyl)fluorene and isophthalic acid, terephthalic acid or mixtures thereof, polyethylene, polypropylene, polyvinyl chloride and copolymers thereof, hydrolyzed and unhydrolyzed cellulose acetate. Preferably the donor substrate is transparent.

The thermal transfer donor elements may be prepared by introducing the components for making the propellant and/or thermal mass transfer material layer into suitable solvents (e.g., tetrahydrofuran (THF), methyl ethyl ketone (MEK), toluene, methanol, ethanol, n-propanol, isopropanol, acetone, etc., and mixtures thereof); mixing the resulting solutions at, for example, room temperature; coating the resulting mixture onto the substrate; and drying the resultant coating, preferably at moderately elevated temperatures. Suitable coating techniques include knife coating, roll coating, curtain coating, spin coating, extrusion die coating, gravure coating, etc. The contribution of the propellant layer to the color of the final images is less than 0.2, preferably less than 0.1, absorbance units. Preferably, the propellant layer has a thickness of from about 0.0001 mm to about 0.01 mm, more preferably from about 0.005 mm to about 0.0002 mm.

When the thermal mass transfer material is coated as a separate layer on the propellant it may be coated by a variety of techniques including, but not limited to, coating from a solution or dispersion in an organic or aqueous solvent (e.g., bar coating, knife coating, slot coating, slide coating, etc.), vapor coating, sputtering, gravure coating, etc., as dictated by the requirements of the transfer material itself. The thermal transfer material may optionally be highly colored and preferably has a thickness of from about 0.0001 mm to about 0.01 mm, more preferably from about 0.0003 mm to about 0.002 mm.

The thermal transfer donor elements of the present invention are used by placing them in intimate contact (e.g., vacuum hold-down) with a receptor sheet and imagewise heating the thermal transfer donor element. In order to provide rapid heating one or more laser beams are used to provide the energy necessary for transfer. Single-mode laser diodes and diode-pumped lasers producing, for example, 0.1–4 Watt (W) in the near-infrared region of the electromagnetic spectrum may be used as energy sources. Preferably, a solid state infrared laser or laser diode array is employed. Laser exposure dwell times should be from about 0.1 to 5 microseconds and laser fluences should be from about 0.01 to about 1 J/cm$^2$.

The radiation absorber serves to sensitize the thermal transfer donor element to various wavelengths of radiation. The radiation absorber also serves to convert incident electromagnetic radiation into thermal energy. F/r this reason it is generally desirable that the radiation absorber have low fluorescence and phosphorescence quantum efficiencies and undergo little or not net photochemical change upon exposure to electromagnetic radiation. It is also generally desirable for the radiation absorber to be highly absorptive of the incident radiation so that a minimum amount (7eight percent for soluble absorbers or volume percent for insoluble absorbers) can be used in coatings. Non-limiting examples of radiation absorbers include pigments such as carbon black (i.e., acetylene black, channel black, furnace black, gas black, and thermal black), bone black, iron oxide (including black iron oxide), copper/chrome complex black azo pigments (e.g., pyrazolone yellow, dianisidine red, and nickel azo yellow), black aluminum, and phthalocyanine pigments. In addition to pigments, the radiation absorber may be a dye as described, for example, in M. Matsuoka *Absorption Spectra of Dyes for Diode Lasers*: Bunshin Publishing C/.; Tokoyo, 1990.

Preferably, the radiation absorber employed in the thermal transfer donor element absorbs in the near-infrared or infrared region of the electromagnetic spectrum. In some instances, it may be desirable to employ absorbers which absorb in the visible region of the electromagnetic spectrum.

Suitable image-receiving (thermal mass transfer-receiving) elements are well known to those skilled in the art. Non-limiting examples of image-receiving elements which can be utilized in the present invention include anodized aluminum and other metals; transparent polyester films (e.g., PET); and a variety of different types of paper (e.g., filled or unfilled, calendered, etc.).

In the practice of the present invention, the thermal transfer donor and receiving elements are brought into contact with one another such that upon application of heat, the thermal mass transfer material is transferred from the donor element to the receiving element. The radiation absorber utilized in the donor element of the present invention acts as a light-to-heat conversion element. A variety of light-emitting sources can be utilized in the present invention including infrared, visible, and ultraviolet lasers. The preferred lasers for use in this invention include high power (>100 mW) single mode laser diodes, fiber-coupled laser diodes, and diode-pumped solid state lasers (e.g., d:YAG and Nd:YLF), and the most preferred lasers are diode-pumped solid state lasers. The laser exposure should raise the temperature of the thermal transfer medium above 150° C. and most preferably above 200° C.

After transfer of the thermal mass transfer material from the donor to the receiving elements, an image is created on the receiving element and the donor element may be removed from the receiving element.

The donor material can be provided as sheets or rolls. Either of these can be single colored uniformly 7ithin the article, and multiple articles of different colors are used to produce a multi-colored image. Alternately, the donor materials could contain areas of multiple colors, 7ith a single sheet or roll being used to generate multi-colored images.

The following non-limiting examples further illustrate the present invention.

EXAMPLES

Unless noted otherwise, imaging was performed by placing the samples coated side down in a cylindrical drum section equipped with a vacuum hold down, either against a piece of 3M 7600 presentation paper (very smooth filled paper). Imaging 7as performed at 6400, 4800, 3200, and 1600 cm/sec with a Nd:YAG laser at 1.7 W on the film plane and a 18 μm spot (full width at $1/e^2$).

F/ur different substrates were used in the following examples. They are: Plain 4 mil PET, 4 mil PET 7ith black aluminum coating 7hich has a 55% transmission and 7% reflection, ("low TOD") 4 mil PET with black aluminum which has a 10% transmission and 9% reflection, ("high TOD") and 2 mil PET 7ith a coating of shiny aluminum which has a 34% transmission and 36% reflection.

AD5BMO Preparation

Poly BAMO (poly[bis(azidomethyl)/xetane]) was obtained from the Aerojet corp. The material had a mw of about 4500 as determined by GPC. A suspension of 5 g of poly BAMO in 45 g of MEK was warmed to 60° C. 7ith swirling until the polymer dissolved and then 250 mg of acetylene dicarboxylic acid was added. The resulting solution was heated in a sealed jar at 60° C. for 3 hours and then cooled to room temperature before use. NMR analysis indicated the reaction of the alkyne, presumably to form the substituted triazole in the produced AD5BMO.

C1: To prepare a cyan pigment dispersion, the following composition was two roll milled with several passes until the mixture produced a good dispersion upon dispersing in MEK:

3 parts Sun Pigment 249-0592 (Phthalocyanine blue C/lor index 15:2) and 2 parts VAGH resin (vinyl resin from Union Carbide).

The resulting material was crushed to form 1 cm chunks, and dissolved (5 parts in 50 parts MEK) using a Silverson high sheer mixer at half speed for 50 minutes.

A Microlith Red RBS-WA dispersion was prepared according to the recommendations of the manufacturer (CIBA-GEIGY C/rp.), using distilled 7ater, concentrated aqueous ammonia and isopropyl alcohol and used as follows.

63:

3 g 7ater 1.2 g C.-G. red dispersion (25% wt. solids)

0.3 g Vancryl 600 emulsion (an aqueous latex vinylchloride-ethylene adhesive Air Products and Chemicals Inc.)

1 g (5% wt. solids solution of FC 170C fluorocarbon surfactant (3M) in 1:1 iPrOH:$H_2O$)

63M:

3 g water 1.2 g C.-G. red dispersion (25% wt. solids)

0.5 g Vancryl 600 emulsion (Air Products and Chemicals Inc.)

0.6 g (5% wt. solids solution of a sulfonamide fluorocarbon surfactant (3M) in iPrOH 10A solution: to 20 parts of the C1 cyan dispersion was added 1 part of a 10% solids solution in MEK of a sulfonamidefluorocarbon surfactant (3M). This mixture was used as a stock solution as follows:

EXAMPLE 1

10A: was coated using a #4 Mayer rod on the substrates listed in table 1. Each of these was dried in an oven at 60° C. for 2 minutes, and imaged as above. ROD of the solid imaged area where imaging was complete 7as found to be 1.3 using a Gretag D-186 and status T filters. No discoloration of the imaged areas due to transferred black aluminum was apparent at the lower speeds.

EXAMPLE 2

10B: in 21 parts of 10A was dissolved 0.3 parts of an infrared absorbing dye from the Cyasorb series IR-165 from Glendale Protective Technologies. This 7as coated using a #4 Mayer rod on the substrates listed in table 1. Each of these was dried in an oven at 60° C. for 2 minutes, and imaged as above. ROD /f the solid imaged area where imaging was complete was found to be 1.3 using a Gretag D-186 and status T filters. No discoloration of the imaged areas due to transferred black aluminum was apparent at the lower speeds.

EXAMPLE 3

10C: To 21 parts of 10A 7as added 10 parts of a 10% solids solution of AD5BMO prepared as noted above. This 7as coated using a #6 Mayer rod on the substrates listed in table 1. Each of these was dried in an oven at 60° C. for 2 minutes, and imaged as above. ROD of the solid imaged area where imaging 7as complete 7as found to be 1.3 using a Gretag D-186 and status T filters. No discoloration of the imaged areas due to transferred black aluminum 7as apparent at the lower speeds.

EXAMPLE 4

10EP: A two layer construction 7as made, 7ith the first layer being a 5% solids solution of AD5BMO as described above, coated 7ith a #4 Mayer rod on the substrates listed in table 1. Each of these 7as dried in an oven at 60° C. for 2 minutes, and overcoated with the 63F suspension above with a #4 Mayer rod and then dried in an oven at 60° C. for 2 minutes.

EXAMPLE 5

63F: was coated on each of the substrates listed in table 1. Each of these 7as dried in an oven at 60° C. for 2 minutes, and imaged.

TABLE 1

The numbers in the table indicate the threshold speed (in cm/s) for which significant imaging occurred; a higher number indicates a faster speed of the laser spot and therefor a more sensitive material.

| Substrate: | Black Al high density | Black Al low density | Shiny Al | Plain PET |
|---|---|---|---|---|
| 10A | 4800/3200 | 1600 | | none |
| 10B | 6400 | 6400 | 6400 | 6400 |
| 10C | 4800 | 3200 | none | none |
| 10EP | 1600 | | none | none |
| 63F | 1600 | | none | none |

The black aluminum clearly shows greater speed than shiny aluminum or clear polyester.

EXAMPLE 6

The Donor material resulting from laser exposure of the sample 10B with high density black Aluminum was used to expose a negative-acting Viking TM printing plate. After exposure in a Berkey Askor printing frame equipped with a 2 KW photopolymer bulb and aqueous development using the Viking TM developer, a reversal image of good quality 7as obtained on the printing plate. This example illustrates that the same donor sheet can be used to produce both a proof and a film for a printing plate.

EXAMPLE 7

A donor sheet made from composition 10B on the high density black aluminum was then exposed 7hile in contact with a 3M S2 Viking TM printing plate as substrate. The sample showed good image-wise transfer of the pigmented layer from the donor sheet to produce a lithographic printing plate.

EXAMPLES 8 AND 9

D/nor sheets composed of 10C on black aluminum (high TOD), black aluminum (low TOD), and shiny aluminum and 10EP on black aluminum (high TOD) and shiny aluminum 7ere prepared. These donor sheets were placed in contact 7ith Whatman No. 41 filter paper and exposed through a metal mask using one flash from a Rollei E27 Xenon flash unit. Exposure was through the backside of the donor sheet. The results are indicated below. Yes indicates ablation mass transfer occurred while no indicates no transfer occurred.

| Pigment layer | Substrate Black Al, high density | Black Al, low density | Shiny Al |
|---|---|---|---|
| 10C | yes | no | no |
| 10EP | yes | not tried | no |

This shows that the high density black aluminum is more efficient than the low density black aluminum.

EXAMPLE 10

C/mposition 10M was coated 7ith a No. 4 Mayer bar onto a layer of black aluminum on 0.004" polyester and dried for 2 minutes at 90° C. The optical density of the black aluminum 7as 0.8 (no filter) and the optical density of the magenta layer was 1.2 (green filter). This donor sheet was placed in contact 7ith Whatman No. 41 filter paper and exposed through a metal mask in contact with the back of the donor sheet using one flash from a Rollei E27 flash unit (Rollei-Werke Franke & Hedecke, Germany) to give excellent ablation mass transfer of the magenta pigment layer to paper. The Rollei E27 is rated at a Guide Number of 62 for 25 ASA film and an energy of 58 Wsec. Although the black aluminum layer also ablated there was no evidence of black coloration on the paper receptor.

A 0.003" polyester receptor sheet and the magenta donor sheet 7ere separated 7ith two 0.04" 7idth microscope slides to form an open space between the donor and receptor sheets. This configuration 7as exposed 4hrough the receptor sheet 7ith one flash from the Rollei E27 flash unit. A portion of the magenta layer was ablated from the donor sheet across the 0.04" gap onto the receptor sheet.

EXAMPLE 11

Example 10 was repeated using black tin on 0.004" polyester. Black tin is a metalloid of tin and tin oxide. The optical density of the black tin 7as 1.36. Excellent ablation transfer of magenta pigment layer occurred for both backside exposure in contact with paper and frontside exposure through a polyester receptor separated from the donor sheet by 0.04" using one flash of the Rollei E27 flash unit.

EXAMPLE 12

Example 10 was repeated except that the magenta pigment-binder layer was replaced with vapor coated copper phthalocyanine pigment. The copper phthalocyanine pigment was vapor coated at about 500° C. and $10^{-4}$ torr to give an optical density of 2.9 (red filter). Excellent ablation transfer occurred to paper and polyester using the donor-receptor configurations in Example 1 and one flash from the Rollei E27 flash unit.

EXAMPLE 13

Example 10 was repeated except that the magenta pigment-binder layer 7as replaced with vapor coated (3,5-dimethyl)disperse yellow 11 pigment. The yellow pigment 7as vapor coated at about 300° C. and $10^{-4}$ torr to an optical density of 3.0. Excellent ablation transfer occurred to paper and polyester using the donor-receptor configurations in Example 1 and one &,ash from the Rollei E27 flash unit.

What is claimed is:

1. A thermal transfer donor element comprising a substrate, a black metal layer on one surface of said substrate, a gas generating polymer layer over said black metal layer, and a colorant in or over said gas generating polymer layer, wherein said black metal layer comprises a mixture of metal and metal oxide.

2. The donor sheet of claim 1 in which said colorant is in a layer over said black metal layer.

3. The donor sheet of claim 2 in which said colorant comprises a pigment in a binder.

4. The donor sheet of claim 2 7herein said colorant comprises a dye layer.

5. The donor sheet of claim 2 wherein said colorant consists of a dye layer.

6. A thermal transfer donor element comprising a substrate, a black metal layer on one surface of said substrate, a gas generating polymer layer over said black metal layer, and a colorant in or over said gas generating polymer layer, 7herein said black metal layer is selected from black aluminum or black tin.

7. The donor sheet of claim 6 7herein said black metal comprises a mixture of metal and metal oxide.

8. The donor sheet of claim 6 wherein said black metal layer comprises a mixture of metal oxide and metal.

9. The donor sheet of claim 1 7herein said black metal layer has a transmission optical density of at least 0.3.

10. The donor sheet of claim 3 wherein said black metal layer has a transmission optical density of at least 0.8.

11. The donor sheet of claim 6 7herein said black metal layer has a transmission optical density of at least 0.8 and said substrate is transparent.

12. The donor sheet of claim 1 in 7hich said black metal layer has a transmission optical density of at least 0.8 and said substrate is transparent.

13. The donor sheet of claim 7 in 7hich said black metal layer has a transmission optical density of at least 0.8 and said substrate is transparent.

14. A process for thermal transfer imaging comprising the steps of contacting the top layer of said donor element of claim 6 with a receptor surface and irradiating said donor sheet with sufficient energy to generate gas from said generating layer and transfer colorant to said receptor surface.

15. A process for thermal transfer imaging comprising the steps of contacting the top layer of the donor element of claim 3 with a receptor surface and irradiating said donor sheet 7ith sufficient energy to generate gas from said generating layer and transfer colorant to said receptor surface.

16. A process for thermal transfer imaging comprising the steps of contacting the top layer of the donor sheet of claim 12 7ith a receptor surface and irradiating the gas generating layer through said transparent substrate with sufficient energy to generate gas from said gas generating layer and transfer colorant to said receptor surface.

17. The donor element of claim 6 7herein said black metal layer has a top surface and a bottom surface and the composition of said black metal layer from said top surface to said bottom surface is gradated 7ith respect to concentrations of oxygen.

* * * * *

UNITED STATES PATENT AND TRADEMARK OFFICE

CERTIFICATE OF CORRECTION

PATENT NO. : 5,308,737

DATED : May 3, 1994

INVENTOR(S) : Bills et al.

It is certified that error appears in the above-indentified patent and that said Letters Patent is hereby corrected as shown below:

On the cover page, under section [75] Inventors, second line, replace "if" with --of--.

On the cover page, under section [56] OTHER PUBLICATIONS, second line, replace "Thenical" with --Thermal--.

On the cover page, under section [57] ABSTRACT, next to the last line, replace "7ell" with --well--.

Column 1, line 7, replace "7as" with --was--;

Column 1, line 8, replace "7ater" with --water--;

Column 1, line 12, replace "7/uld" with --would--;

Column 1, line 15, replace "7hich" with --which--;

Column 1, line 24, replace "7ith" with --with--;

Column 1, line 43, replace "7hich" with --which--;

Column 1, line 60, replace "7hich" with --which--;

Column 1, line 64, replace "7hich" with --which--;

UNITED STATES PATENT AND TRADEMARK OFFICE

CERTIFICATE OF CORRECTION

PATENT NO. : 5,308,737

DATED : May 3, 1994

INVENTOR(S) : Bills et al.

It is certified that error appears in the above-indentified patent and that said Letters Patent is hereby corrected as shown below:

Column 2, line 33, replace "7riting" with --writing--;
Column 2, line 43, replace "7ith" with --with--;
Column 2, line 46, replace "7hy" with --why--;
Column 2, line 67, replace "/." with --No.--;

Column 3, line 24, replace "F/r" with --For--;
Column 3, line 27, replace "7ith" with --with--;
Column 3, line 65, replace "7eight" with --weight--;
Column 4, line 26, replace "7hich" with --which--;
Column 4, line 38, replace "7herein" with --wherein--;
Column 4, line 49, replace "F/rmula" with --Formula--;
Column 4, line 60, replace "7herein" with --wherein--;

UNITED STATES PATENT AND TRADEMARK OFFICE

CERTIFICATE OF CORRECTION

PATENT NO. : 5,308,737

DATED : May 3, 1994

INVENTOR(S) : Bills et al.

It is certified that error appears in the above-indentified patent and that said Letters Patent is hereby corrected as shown below:

Column 5, line 5, replace "/." with --No.--;

Column 5, line 8, replace "7eight" with --weight--;

Column 5, line 16, before "$_2$" add --N--;

Column 5, line 19, replace "7ith" with --with--;

Column 5, line 35, replace "F/r" with --For--;

Column 5, line 39, replace "/n" with --on--;

Column 5, line 40, replace "d:YAG" with --Nd:YAG--;

Column 5, line 46, replace "7ide" with --wide--;

Column 5, line 57, replace "7eight" with --weight--;

Column 6, line 58, replace "/ne" with --one--;

Column 6, line 61, replace "7hich" with --which--;

Column 6, line 66, replace "7ith" with --with--;

Column 7, line 2, replace "7hich" with --which--;

Column 7, line 17, replace "7ater" with --water--;

Column 7, line 21, replace "7ith" with --with--;

Column 7, line 64, replace "7hich" with --which--;

Column 7, line 65, replace "7aves" with --waves--;

UNITED STATES PATENT AND TRADEMARK OFFICE

CERTIFICATE OF CORRECTION

PATENT NO. : 5,308,737

DATED : May 3, 1994

INVENTOR(S) : Bills et al.

It is certified that error appears in the above-indentified patent and that said Letters Patent is hereby corrected as shown below:

Column 8, line 63, replace "C/rresponding" with --Corresponding--;

Column 8, line 67, replace "F/rmula" with --Formula--;

Column 9, line 7, replace "F/rmula" with --Formula--;

Column 9, line 37, replace "F/rmula" with --Formula--;

Column 9, line 50, replace "C/polymerization" with --Copolymerization--;

Column 9, line 58, replace "C/lour" with --Colour--;

Column 9, line 59, replace "C/lourists" with --Colourists--;

Column 10, line 12, replace each "C/." with --Co.--;

Column 10 line 28, replace "C/rp." with --Corp.--;

Column 11, line 7, replace "TM" with --™--;

Column 11, line 8, replace "C/mpany" with --Company--;

Column 11, line 65, replace "F/r" with --For--;

UNITED STATES PATENT AND TRADEMARK OFFICE

CERTIFICATE OF CORRECTION

PATENT NO. : 5,308,737

DATED : May 3, 1994

INVENTOR(S) : Bills et al.

It is certified that error appears in the above-indentified patent and that said Letters Patent is hereby corrected as shown below:

Column 12, line 4, replace "7eight" with --weight--;

Column 12, line 16, replace "C/." with --Co.--;

Column 12, line 16, replace "Tokoyo" with --Tokyo--.

Column 12, line 43, replace "d:YAG" with --Nd:YAG--;

Column 12, line 53, replace "7ithin" with --within--;

Column 12, line 57, replace "7ith" with --with--;

Column 12, line 67, replace "7as" with --was--;

Column 13, line 3, replace "F/ur" with --Four--;

Column 13, line 4, replace "7ith" with --with--;

Column 13, line 5, replace "7hich" with --which--;

Column 13, line 8, replace "7ith" with --with--;

Column 13, line 13, replace "/xetane" with --oxetane--;

Column 13, line 17, replace "7ith" with --with--;

Column 13, line 29, replace "C/lor" with --Color--;

UNITED STATES PATENT AND TRADEMARK OFFICE

CERTIFICATE OF CORRECTION

PATENT NO. : 5,308,737

DATED : May 3, 1994

INVENTOR(S) : Bills et al.

It is certified that error appears in the above-indentified patent and that said Letters Patent is hereby corrected as shown below:

Column 13, line 37, replace "C/rp." with --Corp.--;

Column 13, line 37, replace "7ater" with --water--;

Column 13, line 40, replace "63:" with --63F:--;

Column 13, line 41, replace "7ater" with --water--;

Column 13, line 65, replace "7as" with --was--;

Column 14, line 5, replace "7as" with --was--;

Column 14, line 8, replace "/f" with --of--;

Column 14, line 15, replace "7as" with --was--;

Column 14, line 17, replace "7as" with --was--;

Column 14, line 20, replace each "7as" with --was--;

Column 14, line 23, replace "7as" with --was--;

Column 14, line 26, replace "7as" with --was--;

Column 14, line 26, replace "7ith" with --with--;

Column 14, line 28, replace "7ith" with --with--;

UNITED STATES PATENT AND TRADEMARK OFFICE

CERTIFICATE OF CORRECTION

PATENT NO. : 5,308,737

DATED : May 3, 1994

INVENTOR(S) : Bills et al.

It is certified that error appears in the above-indentified patent and that said Letters Patent is hereby corrected as shown below:

Column 14, line 29, replace "7as" with --was--;

Column 14, line 36, replace "7as" with --was--;

Column 14, line 57, replace "TM" with --™--;

Column 14, line 60, replace "TM" with --™--;

Column 14, line 61, replace "7as" with --was--;

Column 14, line 68, replace "7hile" with --while--;

Column 15, line 1, replace "TM" with --™--;

Column 15, line 7, replace "D/nor" with --Donor--;

Column 15, line 10, replace "7ere" with --were--;

Column 15, line 11, replace "7ith" with --with--;

Column 15, line 28, replace "C/mposition" with --Composition--;

Column 15, line 28, replace "7ith" with --with--;

Column 15, line 31, replace "7as" with --was--;

Column 15, line 33, replace "7ith" with --with--;

Column 15, line 44, replace "7ere" with --were--;

Column 15, line 44, replace "7ith" with --with--;

UNITED STATES PATENT AND TRADEMARK OFFICE

CERTIFICATE OF CORRECTION

PATENT NO. : 5,308,737

DATED : May 3, 1994

INVENTOR(S) : Bills et al.

It is certified that error appears in the above-indentified patent and that said Letters Patent is hereby corrected as shown below:

Column 15, line 44, replace "7idth" with --width--;

Column 15, line 46, replace "7as" with --was--;

Column 15, line 47, replace "4hrough" with --through--;

Column 15, line 47, replace "7ith" with --with--;

Column 15, line 55, replace "7as" with --was--;

Column 16, line 6, replace "7as" with --was--;

Column 16, line 8, replace "7as" with --was--;

Column 16, line 11, replace "&,ash" with --flash--;

Claim 4, Column 16, line 24, replace "7herein" with --wherein--;

Claim 6, Column 16, line 32, replace "7herein" with --wherein--;

Claim 7, Column 16, line 34, replace "7herein" with --wherein--;

Claim 9, Column 16, line 39, replace "7herein" with --wherein--;

Claim 11, Column 16, line 44, replace "7herein" with --wherein--;

UNITED STATES PATENT AND TRADEMARK OFFICE

CERTIFICATE OF CORRECTION

PATENT NO. : 5,308,737

DATED : May 3, 1994

INVENTOR(S) : Bills et al.

It is certified that error appears in the above-indentified patent and that said Letters Patent is hereby corrected as shown below:

Claim 12, Column 16, line 47, replace "7hich" with --which--;

Claim 13, Column 16, line 50, replace "7hich" with --which--;

Claim 14, Column 16, line 57, after the word "said" and before the word "generating", insert --gas--.

Claim 15, Column 16, line 62, replace "7ith" with --with--;

Claim 15, Column 16, line 63, after the word "said" and before the word "generating", insert --gas--.

Claim 16, Column 16, line 67, replace "7ith" with --with--;

Claim 17, Column 17, line 4, replace "7herein" with --wherein--;

Claim 17, Column 18, line 2, replace "7ith" with --with--.

Signed and Sealed this

Eleventh Day of October, 1994

*Attest:*

Bruce Lehman

BRUCE LEHMAN

*Attesting Officer*

*Commissioner of Patents and Trademarks*